US005787857A

United States Patent [19]

Simons

[11] Patent Number: 5,787,857

[45] Date of Patent: Aug. 4, 1998

[54] FUEL INJECTED INTERNAL COMBUSTION ENGINE

[76] Inventor: Sylvan Simons, 48 Beech St., Port Chester, N.Y. 10573

[21] Appl. No.: 571,477

[22] Filed: Dec. 13, 1995

[51] Int. Cl.[6] ..... F02B 3/00; F02P 15/08

[52] U.S. Cl. ..... 123/298; 123/641

[58] Field of Search ..... 123/298, 260–1, 123/305, 169 V, 179.5, 179.16, 596–8, 640–1, 620–1

[56] References Cited

U.S. PATENT DOCUMENTS

| | | | |
|---|---|---|---|
| 3,079,453 | 2/1963 | Clark | 123/169 V |
| 4,061,113 | 12/1977 | Beyler | 123/169 V |
| 4,105,010 | 8/1978 | Rand, Jr. | 123/169 V |
| 4,164,912 | 8/1979 | Beyler | 123/169 V |
| 4,202,307 | 5/1980 | Imamura | 123/169 V |
| 4,235,214 | 11/1980 | Ito | 123/169 V |
| 4,328,771 | 5/1982 | Kawai et al. | 123/179.5 |
| 4,852,525 | 8/1989 | Ishida | 123/260 |
| 5,058,548 | 10/1991 | Morikawa et al. | 123/298 |
| 5,179,928 | 1/1993 | Cour et al. | 123/620 |
| 5,207,208 | 5/1993 | Ward | 123/596 |
| 5,220,901 | 6/1993 | Morita et al. | 123/620 |
| 5,247,919 | 9/1993 | Akaki et al. | 123/640 |
| 5,335,635 | 8/1994 | Kadoi et al. | 123/298 |

*Primary Examiner*—Thomas N. Moulis
*Attorney, Agent, or Firm*—Alfred E. Miller

[57] ABSTRACT

A Diesel engine is started as a direct fuel injected engine with ignition accomplished by spraying fuel onto a hot wire electrode that is made hot as part of a spark plug activated by an enhanced ignition system. The fuel injector's normally atomized spray pattern is changed to a concentrated fuel sprayed on to the hot wire electrode resulting in ignition of the sprayed fuel. Upon the engine reaching proper temperature, the injector's restrictor is removed, the spark plug is deactivated, and the engine reverts to Diesel operation.

10 Claims, 5 Drawing Sheets

FUEL INJECTED INTERNAL COMBUSTION ENGINE

The present invention relates to a starting system for a diesel engine that uses a spark ignition that is accompanied by spraying fuel onto a hot wire electrode which is heated as part of the spark plug operated by an enhanced ignition system. Fuel injection uses a unique spray pattern that is sprayed on the hot wire electrode resulting in the ignition of the sprayed fuel. When the engine reaches Diesel operating temperatures, fuel spray pattern and the engine reverts to known Diesel operation.

The present invention is particularly adapted to Diesel engines for better operating efficiency and relaxing of traditional fuel restraints associated with Diesel engines.

BACKGROUND OF THE INVENTION

It is well known that there is better fuel economy by Diesel engines as compared to gasoline engines. However, Diesel powered passenger autos, which were manufactured and sold in the past, have not proved popular to the ordinary driver. Thus, the use of Diesel passenger autos is scarce. A principal cause of the unpopularity of the Diesel passenger auto engine is probably attributable to the poor cold weather starting capability of the Diesel engine. In that regard, Diesel auto engines utilize electric heaters, commonly referred to as glow plugs, as a starting aid for heating the fuel spray discharges into the combustion chamber, with limited success. It appears that many attempts have been made to overcome this disadvantage but with no avail.

SUMMARY OF THE INVENTION

In order to overcome the above disadvantage a better starting or ignition system for a Diesel engine than the present glow plug system had to be created. This is accomplished in the present invention by:

1) The glow plug is replaced by a spark plug with an elongated electrode. This electrode is heated by repeated activation of the spark plug energized independent of the rotation of the engine, and at a more rapid rate, by an enhanced ignition system, as shown in my U.S. Pat. No. 5,297,519, which is incorporated herein by reference.

2) The Diesel engine is not started as a Diesel but is, instead, started as a direct fuel injected engine with fuel directed at a hot spark plug electrode providing ignition. Thus, upon the engine reaching a high enough temperature for proper Diesel operation, the engine changes to proper, well known Diesel operation, which is otherwise known as compression ignition.

It is a feature of the present invention to provide a fuel injector spray pattern which is changed from atomization to more dense or concentrated spray injecting fuel through a small orifice in the form of a concentrated spray on the hot spark plug electrode. It should be noted that the atomized Diesel spray from the usual Diesel fuel injectors is not concentrated enough to expand the ignition area when ignited by a localized source, such as a sparking or hot wire.

Another feature of the present invention is to provide an enhanced ignition system with a spark plug to start a Diesel engine which has both a capacitive discharge system to initiate sparking and an inductive discharge system that extends the duration of the sparking, and the fuel is ignited when it comes in contact with the heated spark plug electrode.

Another feature of the present invention is a provision of an injector rotor in an adaptor housing having an opening for injecting fuel which can rotate the injector between a small orifice for liquefying fuel directed at the spark plug to a larger opening, with minimum restriction, for directing the fuel into the combustion chamber when the engine reaches the temperature for proper Diesel operation.

A further feature of the present invention is to provide a spark plug with larger dimensions and a longer insulator than normal spark plugs to provide protection against fuel oil-based insulator fouling.

The above and other objects and features of the invention will be apparent by reference to the following description of my invention and drawings.

DESCRIPTION OF THE PREFERRED EMBODIMENTS

Figure 1:
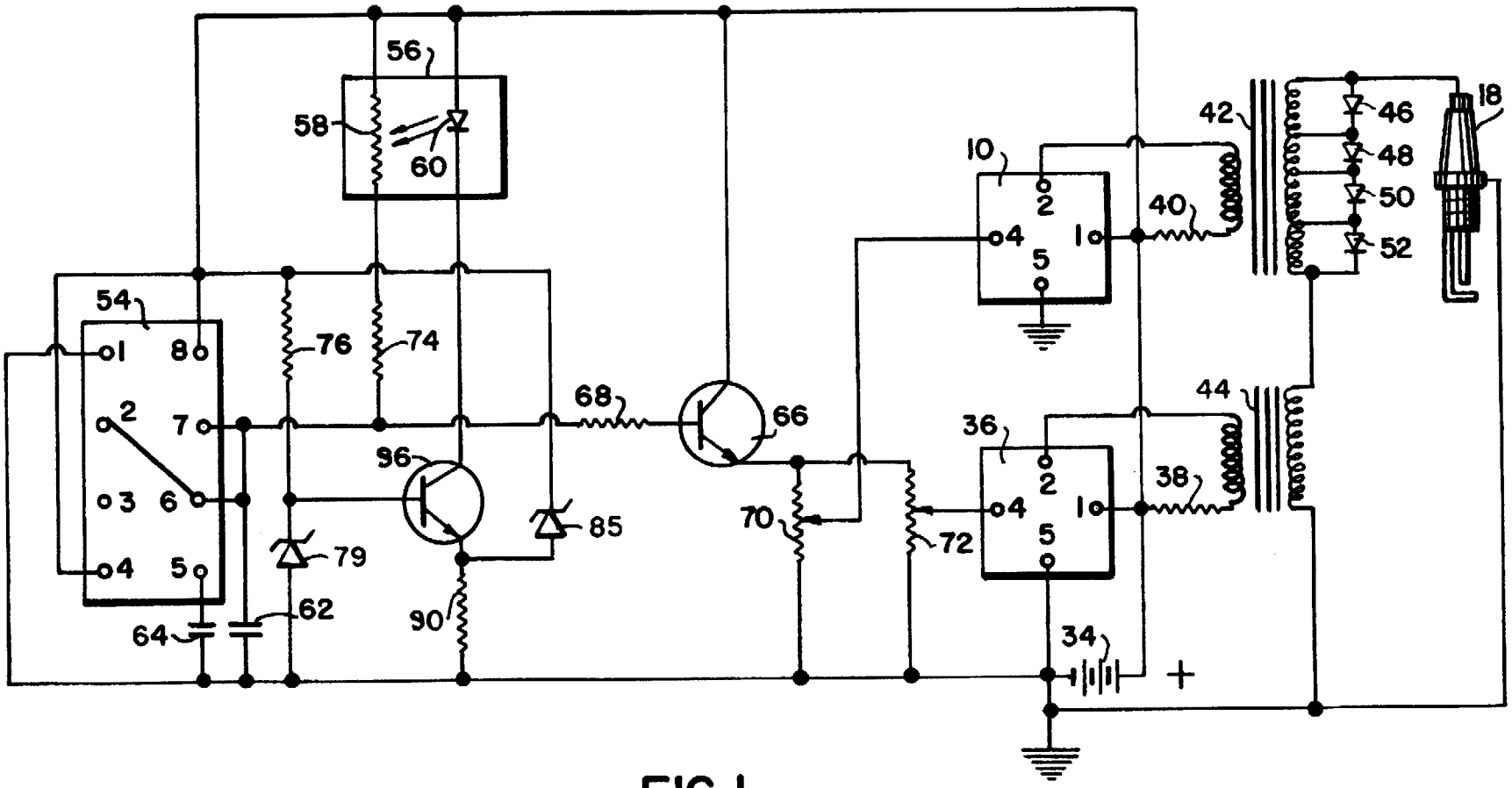
FIG. 1 is a circuit diagram of a system in accordance with the present invention.

Referring now to FIG. 1, the improved, enhanced ignition system shown herein is based upon the disclosure of my U.S. Pat. No. 5,297,519 with a modification that the ignition controller 10 is changed from an inductive discharge unit to a capacitive discharge unit because the capacitive discharge unit generates a higher voltage output and superior ability to generate sparking with a fouled spark plug insulator. Transformer 42, which formerly functioned as an inductive discharge transformer, now functions with the same specifications as a capacitive discharge ignition transformer and can be either an inductive or capacitive discharge with a secondary winding divided into four sections of equal voltage with taps for connection of diodes 46, 48, 50 and 52 and which are poled to by-pass the electric current from the inductive discharge unit transformer 44 around capacitive discharge unit 42 and directed to the spark plug 18 when transformer 44 discharges. The diodes 46, 48, 50 and 52 are Fagor HVR3-12 and have a 12K volt rating for a 48K limit for a series of four, which is made necessary because of the unavailability of a single diode to withstand 48K volts. The tapped transformer winding connections insure that each diode is subject only to it's share of the total voltage.

The enhanced ignition system comprises an astable multivibrator 54 which may be a type 555 integrated circuit, with pin nos. 1–8 illustrated on this device corresponding to industry standard pin numbers of the type 555 multivibrator. Pin nos. 2 and 6 are connected together for 555 self-triggering. The multi-vibrator oscillator 54 has it's output converted to a saw tooth wave shape by resistors 58 and 74 in conjunction with capacitor 62. This output current is amplified by an emitter follower which is a Darlington bi-polar transistor No. MPS A13, which also provides isolation between the multivibrator oscillator 54 and the ignition circuits. Resistor 68, which is 1k ohms limits the tendency of transistor 66 to oscillate parasitically. Capacitor 64 which is 0.01 mfd stabilizes the internal circuitry of the 555 multivibrator oscillator. The combination of resistor 74 which is 100k ohms in conjunction with optocoupler resistor 58 which is approximately 400k ohms when optocoupler diode 60 is de-energized and capacitor 62 which is 0.01 mfd determine the frequency of multivibrator oscillator 54. Optocoupler 56 is a Vactec VTL5C4 consisting of LED 60 and resistor 58. The resistance of resistor 58 varies between 400k ohms when the optocoupler is de-energized to 200 ohms when LED 60 is fully energized. This variation in resistance of 58 is utilized to vary the frequency of the multivibrator oscillator 54 to activate the ignition system at a more rapid rate when activating the engine starter motor reduces the battery voltage.

The circuit utilizing Zener diodes 79 and 85, resistors 76 and 90, and transistor 96 comprise a low voltage actuator that upon activation reduces the resistance 58 in optocoupler 56 to increase the rate of ignition actuation. Zener diode 79 is a 5.1 volt Zener 1N4733. Zener diode 85 is a 6.8 volt Zener 1N5342, resistor 76 is a 33k ohms, ½ watt, resistor 90 is a 56 ohms, 1 watt, and transistor 86 is a 2N2222.

The Zener diodes function in the low voltage actuator is to short circuit transistor 86 forward bias both for the base and the emitter when the battery voltage is at least 12 volts. When the voltage drops below what is needed for the Zeners to conduct current, the transistor 96 is forward biased and activates the optocoupler thereby reducing the resistance of 58.

Transistor 66 is an MPSA-13 NPN Darlington which is connected as an emitter follower to provide isolation between the oscillator and the ignition circuits. Potentiometers 70 and 72 are each of 2k ohms in the emitter of the emitter follower 66 permit adjusting the triggering point of each of the ignition systems. This is accomplished by varying the point on the sawtooth voltage ramp which triggering occurs. Thus, phasing between the two ignition systems can be controlled so that time interval between when the capacitive discharge ignition system fires and the inductive discharge ignition system is activated can actually be controlled for optimum sparking.

Upon actuation, the capacitive discharge ignition circuit includes a capacitive discharge controller 10 and a transformer 42 to initiate sparking in the spark plug 18 which is added to, and the duration extended by, the inductive discharge Kettering type circuit consisting of an inductive discharge ignition controller 36 and a transformer 44. The current flowing from the transformer 44 is applied to the spark plug 18 without loss in the transformer 42 because diodes 46, 48, 50, and 52 by-pass the capacitive discharge transformer 42. In the present invention, the usual inductive discharge ignition transformer can be replaced with a lower turns ratio transformer, such as a Thordarsen CFP-700 with a 230 volt primary and a 10 volt secondary, with the winding functions reversed whereby the 10 volt secondary serves as the primary winding. The lower turns ratio is permissible since the inductive discharge section consisting of module 36, and the transformer 44 no longer has to have a high voltage to initiate sparking, since the sparking can be accomplished by the capacitive discharge system by module 10 and transformer 42. It should be apparent that the inductive discharge ignition circuit as now being utilized supplies higher current to maintain sparking at a fraction of the voltage necessary for initiating sparking, thus permitting the use of a lower turns ratio on transformer 44 and, consequently, resulting in a higher current.

Referring now to FIGS. 2, 3–7 fuel injector adaptor constructed in accordance with the teachings of my invention is shown retro-fitted into a Volkswagen Diesel engine where the glow plug was originally placed. The hole for the glow plug has been enlarged and tapped for an 18 mm×2 thread and a 1½ inch long nipple of that thread size which is screwed into place to accept the adapter. The adapter housing 174 can be disassembled, as seen in the exploded view in FIG. 3 into two mating pieces, to receive the rotor 176 which has a 1 inch diameter at the body 78 and has opposite flanges 80 to contain the rotor within the housing 174. When the rotor is assembled within the adapter housing 174 the combined structure is held together by screws 82. Fitted within the rotor body 176 is a Diesel fuel injector 84 passing through opening 88 in the rotor when the engine is in operation. The Diesel fuel injector is preferably model 14 manufactured by Stanodyne Diesel Systems.

In place of the original Volkswagen fuel injector is a spark plug 18 with the same outside dimensions as the original Volkswagen fuel injector. In the present case the spark plug 18 is longer than the usual spark plug and, consequently, a longer insulator 71 is used than that which is common with presently known spark plugs. The longer insulator provides protection against fuel oil based insulator fouling. A check valve 81 is connected to the spark plug jacket 83. The check valve 81, which is normally closed, opens upon a vacuum created on the intake stroke of the engine in order to provide fresh air in the vicinity of the spark plug electrode 196.

Figure 2:
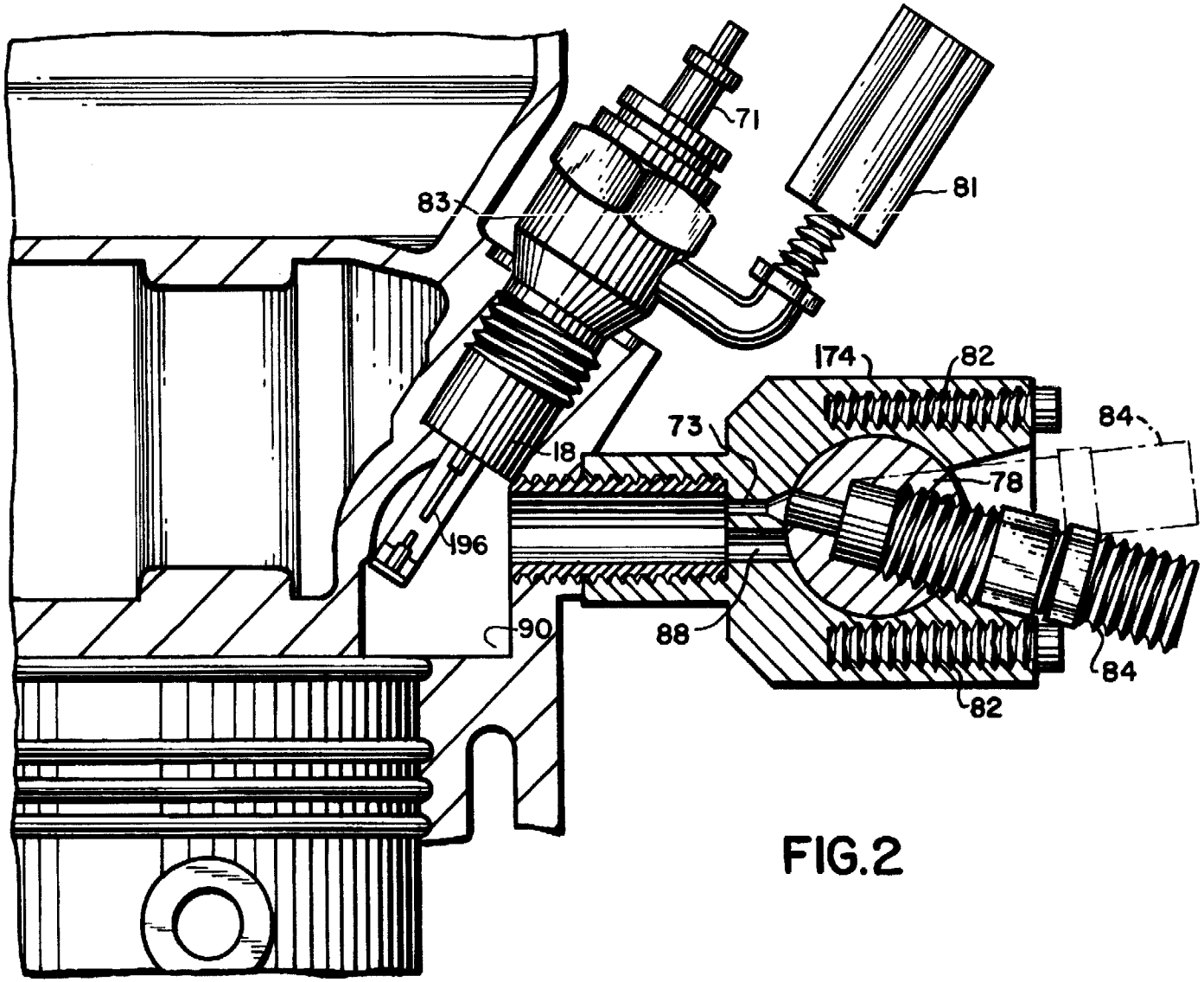
FIG. 2 is a view partly in section and partly in elevation of the combustion chamber, spark plug and fuel injector adapter constructed in accordance with the present invention.
Figure 3:
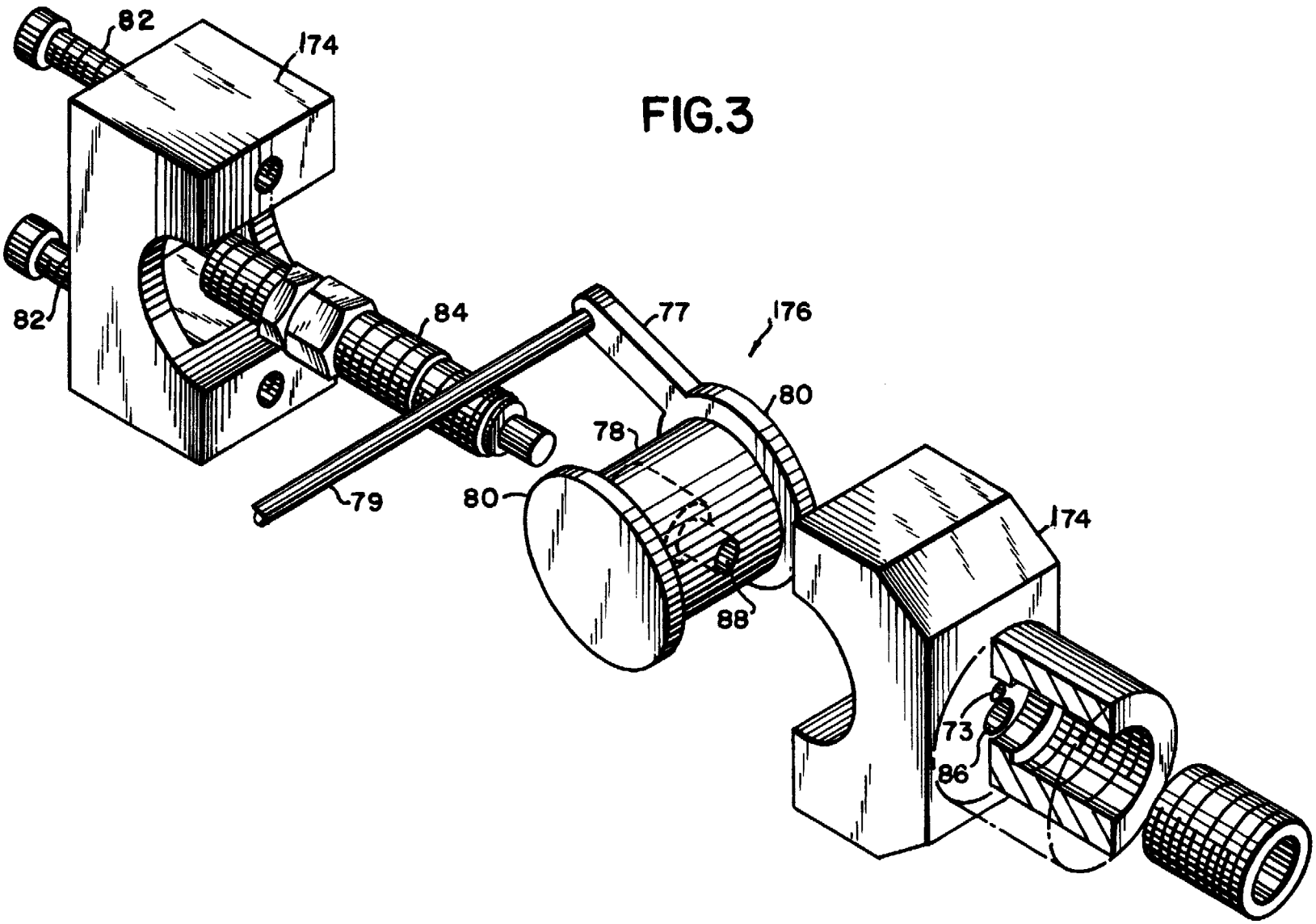
FIG. 3 is an exploded perspective view of the rotor of the fuel injector adaptor.
Figure 4:
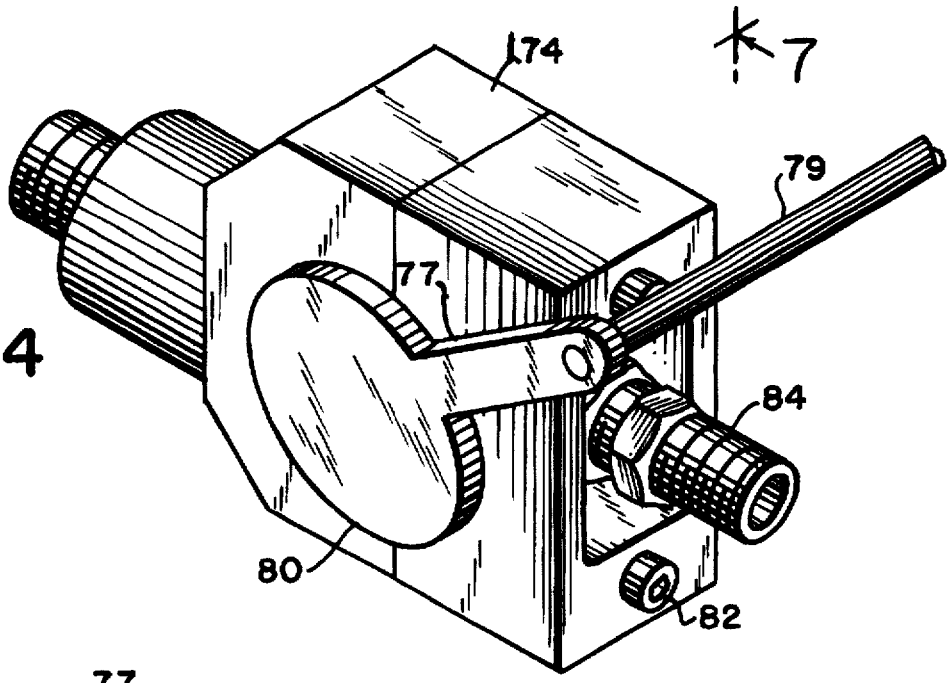
FIG. 4 is a front perspective view of the assembled rotor of the fuel injector adaptor as shown in FIG. 3.
Figure 5:
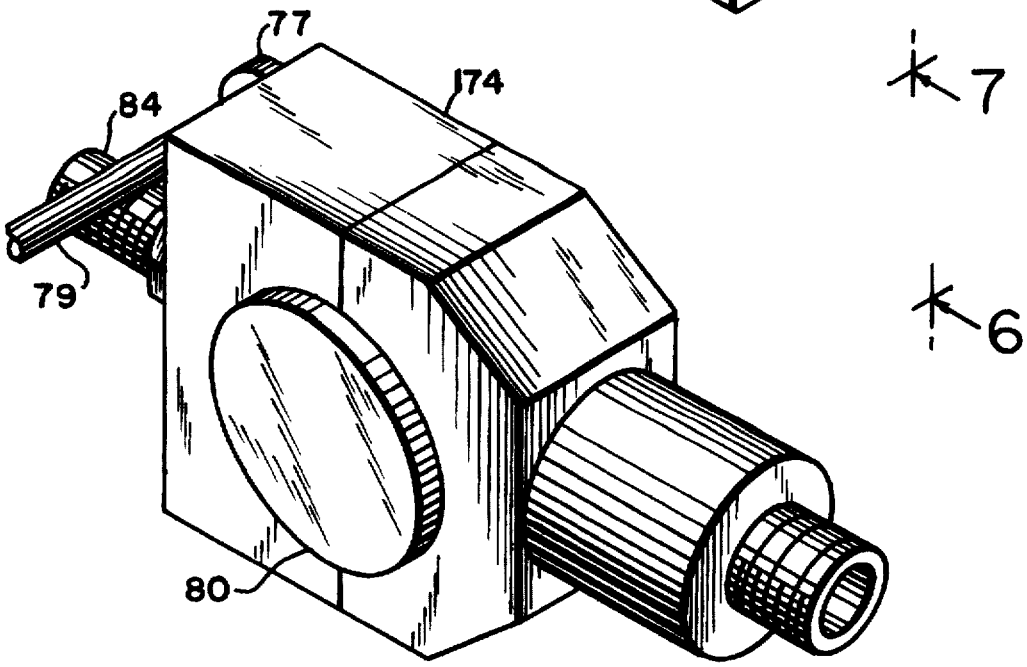
FIG. 5 is a rear perspective of the assembled rotor.
Figure 7:
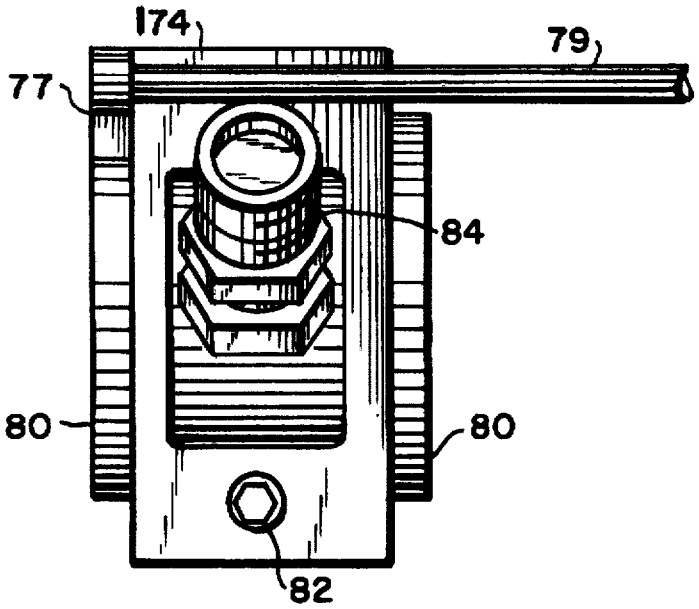
FIG. 7 is a view taken along the lines 7—7 of FIG. 4.
Figure 6:
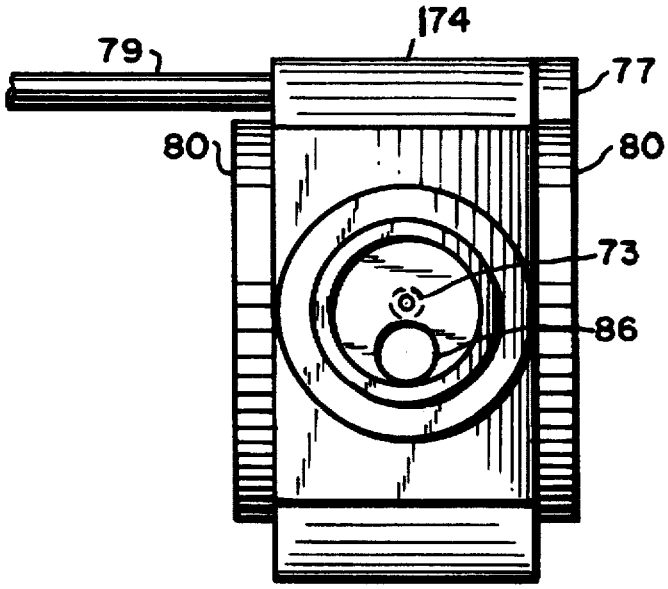
FIG. 6 is a view taken along the lines 6—6 of FIG. 5

Referring to FIG. 2, when the rotor 78 is in the position shown therein the fuel spray is restricted by a 1/64 inch diameter orifice 73 to liquify fuel directed into the combustion chamber 90 and at the electrode 196 of the spark plug 18 for starting the engine. When the engine reaches the proper temperature for Diesel operation the rotor is rotated counterclockwise by means of an arm (not shown) connected to a rod 79 that can be activated from a vehicle compartment or cab to realign to the larger opening 88 with minimum restriction for the fuel spray, which theretofore has a wider pattern. It should be noted, that when the fuel injection adaptor is in the starting position with the fuel injector aligned with the restricted orifice 73, the spark plug 18 is being activated by the ignition system, as described hereinbefore.

While the present invention has been disclosed with reference to certain embodiments thereof, it should be apparent that other variations and embodiments may be made, which fall within the true scope of the invention, as defined in the following claims:

What I claim is:

1. An internal combustion engine having a combustion chamber, a spark plug in said combustion chamber provided with an electrode, means for heating said electrode, a fuel injector for spraying non-atomized fuel on said heater electrode, means to alter the output spray pattern of said fuel injector in order to satisfy varying operating requirements of said engine, and wherein said means for altering the output spray pattern of the fuel injector is an element having a restricted orifice through which the fuel injector can be selectively aligned for spraying liquified fuel on said electrode.

2. The combination as claimed in claim 1 wherein when said fuel passes through said restricted orifice a less atomized fuel results, the output from said orifice contacts said heated electrode to create combustion causing the engine temperature to rise sufficiently to operate as a compressor ignition engine with the restriction removed from said fuel injector.

3. The combination as claimed in claim 1 wherein said electrode is heated by the sparking and electric current of said ignition system.

4. A direct fuel injected engine as claimed in claim 1 wherein ignition is created by spraying fuel on the heated electrode of said spark plug.

5. The direct fuel injected engine as claimed in claim 4 further comprising a valve for said air supply means which is normally closed but opens on the engine intake cycle.

6. A method of starting a Diesel engine wherein said sprayed fuel is ignited by a spark plug activated initially by a capacitive discharge ignition system and, after spark plug sparking is established, an inductive discharge ignition system adds to the sparking by means of poled diodes by-passing said capacitive discharge ignition system.

7. A method of starting a Diesel engine as claimed in claim 6 where sprayed fuel is ignited by a spark plug and said sprayed fuel is substantially more dense than what is suitable for compression ignition.

8. A method of starting a Diesel engine as claimed in claim 6 wherein said sprayed fuel is ignited by contacting said spark plug electrode, said spark plug electrode heated by the sparking of the electrode.

9. The method as claimed in claim 6 further comprising providing means to adjust the activation of the spark plug to compensate for any variation in ignition system current.

10. The method as claimed in claim 9 wherein said means to adjust the activation of the spark plug comprises varying the resistance or capacitance of a timing circuit.

* * * * *